US010837658B2

(12) United States Patent
Nishimura et al.

(10) Patent No.: US 10,837,658 B2
(45) Date of Patent: Nov. 17, 2020

(54) AIR CONDITIONER

(71) Applicant: Shinwa Controls Co., Ltd., Kawasaki (JP)

(72) Inventors: Kenji Nishimura, Kawasaki (JP); Isamu Sasaki, Kawasaki (JP); Yosuke Ikeda, Kawasaki (JP)

(73) Assignee: Shinwa Controls Co., Ltd., Kawasaki (JP)

( * ) Notice: Subject to any disclaimer, the term of this patent is extended or adjusted under 35 U.S.C. 154(b) by 0 days.

(21) Appl. No.: 15/757,137

(22) PCT Filed: Sep. 5, 2016

(86) PCT No.: PCT/JP2016/075963
§ 371 (c)(1),
(2) Date: Mar. 2, 2018

(87) PCT Pub. No.: WO2017/043436
PCT Pub. Date: Mar. 16, 2017

(65) Prior Publication Data

US 2018/0274802 A1 Sep. 27, 2018

(30) Foreign Application Priority Data

Sep. 7, 2015 (JP) ..... 2015-176025

(51) Int. Cl.
*F24F 3/14* (2006.01)
*F24F 11/72* (2018.01)
(Continued)

(52) U.S. Cl.
CPC ..... *F24F 3/14* (2013.01); *F24F 3/153* (2013.01); *F24F 11/72* (2018.01); *F24F 11/81* (2018.01);
(Continued)

(58) Field of Classification Search
CPC .... F24F 3/14; F24F 11/81; F24F 11/72; F24F 3/153; F24F 13/02; F24F 13/10
See application file for complete search history.

(56) References Cited

U.S. PATENT DOCUMENTS 2,260,477 A * 10/1941 Newton ..... F24F 3/14 165/228
2,342,689 A * 2/1944 Pennington ..... F24F 3/14 62/91
(Continued)

FOREIGN PATENT DOCUMENTS

JP S51-017356 U 2/1976
JP S53-2941 Y2 1/1978
(Continued)

OTHER PUBLICATIONS

International Search Report and Written Opinion (Application No. PCT/JP2016/075963) dated Nov. 29, 2016.
(Continued)

*Primary Examiner* — Christopher R Zerphey
(74) *Attorney, Agent, or Firm* — Burr & Brown, PLLC

(57) ABSTRACT

An air conditioner includes: a duct including an upstream flow path unit having an inlet through which air is taken in, and a downstream flow path unit provided with an outlet through which the air is discharged; a cooling unit positioned in the upstream flow path unit of the duct and cools the air; and a heating unit that is positioned in the downstream flow path unit of the duct and heats the air. The upstream flow path unit has a partition plate that partitions an inside space thereof into a main-flow flow path and a sub-flow flow path. The cooing unit is positioned in the main-flow flow path. The upstream flow path unit is provided with a flowrate adjusting member that covers at least
(Continued)

a part of the sub-flow flow path so as to adjust an opening area of the sub-flow flow path.

2 Claims, 5 Drawing Sheets

(51) Int. Cl.

| | |
|---|---|
| ***F24F 11/81*** | (2018.01) |
| ***F24F 3/153*** | (2006.01) |
| ***F24F 13/02*** | (2006.01) |
| ***F24F 13/10*** | (2006.01) |
| ***F24F 6/02*** | (2006.01) |
| ***F24F 13/12*** | (2006.01) |
| *F24F 110/10* | (2018.01) |
| *F24F 110/20* | (2018.01) |

(52) U.S. Cl.
CPC ..... *F24F 13/02* (2013.01); *F24F 13/10* (2013.01); *F24F 2110/10* (2018.01); *F24F 2110/20* (2018.01)

(56) References Cited

U.S. PATENT DOCUMENTS

| | | | | | |
|---|---|---|---|---|---|
| 2,504,278 | A * | 4/1950 | Read | F24F 3/14 | 236/44 A |
| RE26,430 | E * | 8/1968 | Beeler | F24F 3/14 | 165/211 |
| 3,406,743 | A * | 10/1968 | Gomez | G07F 9/105 | 165/229 |
| 3,908,752 | A * | 9/1975 | Padden | F24F 3/14 | 165/247 |
| 3,958,628 | A * | 5/1976 | Padden | F24F 3/14 | 165/222 |
| 4,043,141 | A * | 8/1977 | Levy | F24F 3/14 | 261/106 |
| 4,494,596 | A * | 1/1985 | Bradshaw | F24F 3/14 | 165/101 |
| 2013/0139996 | A1 | 6/2013 | Hashimoto | | |
| 2017/0045244 | A1* | 2/2017 | Lee | F24F 3/12 | |
| 2018/0224145 | A1* | 8/2018 | Tajima | B01D 53/26 | |

FOREIGN PATENT DOCUMENTS

| | | | |
|---|---|---|---|
| JP | S60-063722 | U | 5/1985 |
| JP | H02-013923 | U | 1/1990 |
| JP | H04-048137 | A1 | 2/1992 |
| JP | H09-002053 | A1 | 1/1997 |
| JP | H10-089718 | A1 | 4/1998 |
| JP | 2001-041495 | A1 | 2/2001 |
| JP | 2004-028421 | A1 | 1/2004 |
| JP | 2008-151453 | A1 | 7/2008 |
| JP | 2013-108652 | A1 | 6/2013 |

OTHER PUBLICATIONS

English translation of International Preliminary Report on Patentability (Chapter I) (Application No. PCT/JP2016/075963) dated Mar. 22, 2018, 8 pages.
Korean Office Action (Application No. 10-2018-7009854) dated May 1, 2019 (with English translation).
Chinese Office Action (with English translation), Chinese Application No. 201680050860.3, dated Aug. 29, 2019.

* cited by examiner

AIR CONDITIONER

BACKGROUND OF THE INVENTION

1. Field of the Invention

The present invention relates to an air conditioner.

2. Description of Related Art

When a semiconductor circuit pattern is formed by a photolithography, for example, there are used a photoresist coating apparatus such as a spin coater, an exposure apparatus for exposing the photoresist to light, a developing apparatus for developing the photoresist exposed to light, an etching apparatus for etching a substrate with a resist pattern formed by the developing apparatus as a mask, and so on. A cleanroom in which these various apparatuses are installed, and an inside space of each apparatus are required to have a temperature strictly controlled at a predetermined one. The temperature control is generally performed by an air conditioner.

Various air conditioners have been conventionally proposed as an air conditioner capable of controlling a temperature of a cleanroom and the like. For example, Patent Document 1 discloses an air conditioner by the present Applicant.

Patent Document 1: JP2013-108652A

The air conditioner of Patent Document 1 controls an air taken thereinto such that the air has a desired temperature and a desired humidity by heating and humidifying the air, and supplies the air to a use area. In addition, the air conditioner has a duct configured to divide the air taken thereinto to a main flow and a sub flow. In the duct, a cooling means is disposed in a flow path unit through which a main flow flows. On the other hand, a flowrate adjusting member is disposed in a flow path unit through which a sub flow flows. The flow path unit which a sub flow flows is connected to the main-flow flow path unit on the downstream side of the cooling means. Thus, the air needed to be cooled can be supplied to the cooling means at a corresponding flowrate by the flowrate adjusting member, whereby energy can be saved.

However, in the air conditioner, the main-flow flow path unit and the sub-flow flow path unit are constituted independently from each other, and there are relatively a large number of members such as the cooling means, the heating means, the humidifying means, etc. Thus, the air conditioner is large as a whole, which is disadvantageous.

Moreover, in an air conditioner of such a type for use in a semiconductor manufacturing equipment, humidity is recently required to strictly controlled in addition to a temperature. In particular, in a photoresist coating apparatus used in a photolithography, since properties of a photoresist greatly vary depending not only on a temperature but also on a humidity, there is a strong demand for improving precision in humidity control.

SUMMARY OF THE INVENTION

The present invention has been made in view of the above circumstances. The object of the present invention is to provide an air conditioner capable of saving energy without enlarging the air conditioner as a whole, by means of a member such as a duct that can adjust flowrates of air to be cooled and air not to be cooled in air whose temperature is to be controlled (temperature control target air).

The present invention is an air conditioner comprising: a duct including an upstream flow path unit provided with an inlet through which an air whose temperature is to be controlled is taken in, and a downstream flow path unit provided with an outlet through which the air whose temperature is to be controlled is discharged; a cooling unit that is positioned in the upstream flow path unit of the duct and cools the air whose temperature is to be controlled; and a heating unit that is positioned in the downstream flow path unit of the duct and heats the air whose temperature is to be controlled; wherein: the upstream flow path unit has a partition plate that partitions an inside space thereof into a main-flow flow path and a sub-flow flow path; the cooing unit is positioned in the main-flow flow path; and the upstream flow path unit is provided with a flowrate adjusting member that covers at least a part of the sub-flow flow path so as to adjust an opening area of the sub-flow flow path.

According to the present invention, the upstream flow path unit of the duct, in which the cooling unit is positioned, is partitioned by the partition plate into the main-flow flow path and the sub-flow flow path, and the flowrate adjusting member is installed in order to adjust the opening area of the sub-flow flow path in which the cooling unit is not positioned. Thus, flowrates of air to be cooled and air not to be cooled can be adjusted without enlarging the duct. Since a cooling capacity of the cooling unit can be adjusted depending on a flowrate of air to be cooled, energy saving can be achieved.

The flowrate adjusting member may be removably disposed. Thus, flowrates of air to be cooled and air not to be cooled can be flexibly adjusted.

The flowrate adjusting member may be disposed on the partition plate. In this case, an installation structure of the flowrate adjusting member can be simplified, as compared with a case in which the flowrate adjusting member is directly disposed on the duct, which invites improvement in productivity.

In particular, it is preferable that the flowrate adjusting member is formed to have a plate-like shape, and that the flowrate adjusting member is disposed on the partition plate so as to extend along a direction crossing a direction in which the air whose temperature is to be controlled flows in the upstream flow path unit. In this case, the installation structure of the flowrate adjusting member can be significantly simplified so that the productivity can be effectively improved.

In addition, the upstream flow path unit and the downstream flow path unit may be joined to define an L shape. In this case, the air conditioner can be easily made smaller as a whole, as compared with a case in which the upstream flow path unit and the downstream flow path unit are linearly joined.

In addition, the air conditioner according to the present invention may further comprise a blower that is positioned on a downstream side of the outlet, and causes the air whose temperature is to be controlled to flow from the inlet to the outlet; and a humidifier positioned in the downstream side flow path unit; wherein: the humidifier includes a storage tank that is open upward and stores water, a heater that heats the water in the storage tank, and a cover that covers the storage tank from above; and the cover is partly provided with an opening passing therethrough in an up and down direction. In this case, since a turbulence of water surface of the water in the storage tank, which is affected by air passing through the humidifier, can be restrained, precision in humidity control can be improved.

In particular, a periphery of the opening is preferably provided with a surrounding part that projects toward a bottom side of the storage tank and extends at least partly over the periphery. In this case, even when a water droplet adheres to the periphery of the opening, the water droplet is guided to the surrounding part because of its increasing own weight by growth so as to be easily returned to the storage tank. Thus, since water droplets adhering to the periphery of the opening are prevented from being scattered toward the duct by influence of the air, precision in humidity control can be improved.

In addition, the humidifier may be positioned on the downstream side of the heating unit; the heating unit, the humidifier and the blower may be arranged side by side in a horizontal direction; and the opening may be located at a position in the cover, which position is closer to the heating unit than an end of the cover on the side of the blower. In this case, although eddies tend to be generated in the vicinity of the blower, since an area in which eddies tend to be generated is distant from the opening, the humidity control can be prevented from being affected and disturbed by eddies. Namely, when steam is supplied from the humidifier to an eddy generation area, the steam is not supplied to air and/or the steam may be excessively supplied to air upon elapse of eddies, which affects and disturbs the humidity control. To the contrary, the structure of the present invention can restrain the disturbance of humidity control affected by eddies, whereby precision in humidity control can be improved.

In addition, the opening may be a single opening having an area that is 20% to 60% relative to a whole area of the cover in a plan view. According to the discovery of the present inventor, by providing the cover with a single opening having an area that is 20% to 60% relative to a whole area of the cover in a plan view, precision in humidity control can be improved.

According to the present invention, by means of a member such as a duct that can adjust flowrates of air to be cooled and air not to be cooled in air whose temperature is to be controlled, energy can be saved without enlarging the air conditioner as a whole.

DETAILED DESCRIPTION OF THE INVENTION

Figure 1:
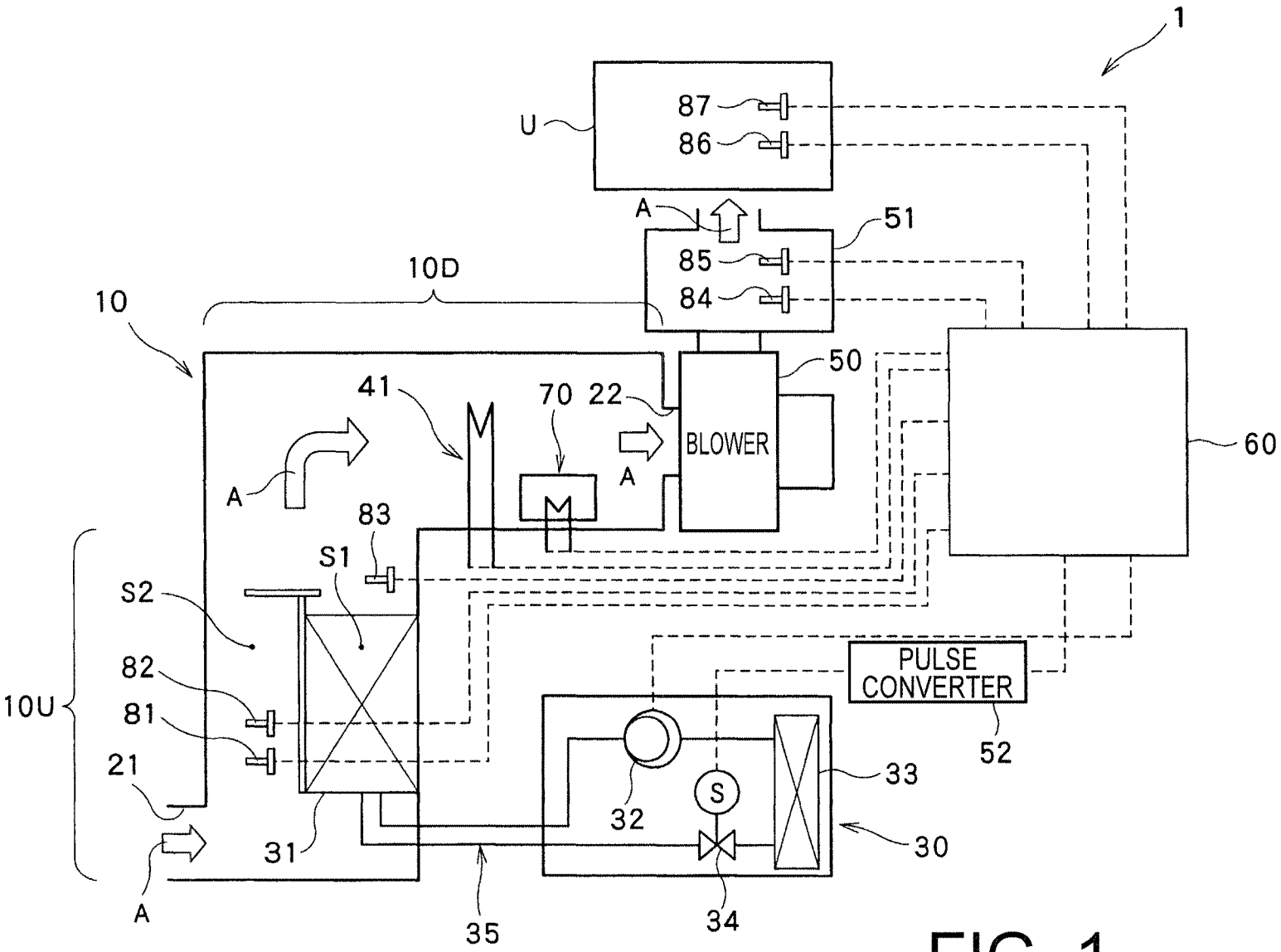
FIG. 1 is a schematic view of an air conditioner according to one embodiment of the present invention.

An embodiment of the present invention will be described in detail below, with reference to the attached drawings. FIG. 1 is a schematic view of a air conditioner 1 according to an embodiment of the present invention. The air conditioner 1 is used for, for example, supplying a coating apparatus for coating a photoresist with a temperature-controlled air so as to maintain constant a temperature inside the apparatus.

As shown in FIG. 1, the air conditioner 1 according to this embodiment includes: a duct 10 including an upstream flow path unit 10U provided with an inlet 21 through which an air whose temperature (temperature control target air) is to be controlled is taken in, and a downstream flow path unit 10D provided with an outlet 22 through which the temperature control target air is discharged; a cooling unit 31 that is positioned in the upstream flow path unit 10U and cools the temperature control target air; a heating unit 41 that is positioned in the downstream flow path unit 10D and heats the temperature control target air; a blower 50 that is disposed on the downstream side of the outlet 22 and causes the temperature control target air to flow from the inlet 21 to the outlet 22; and a control unit 60 that controls the cooling unit 31 and the heating unit 41 and so on.

In FIG. 1, a plurality of arrows A shows a flow of air. As shown by the arrows A, in the air conditioner 1, by means of driving of the blower 50, the temperature control target air taken in from the inlet 21 of the duct 10 passes through the upstream flow path part 10U and the downstream flow path part 10D, and the temperature control target air is then discharged from the outlet 22. Thereafter, the air from the outlet 22 is supplied to a use area U by the blower 50 through a connection flow path 51. The use area U is, for example, an inside space of a coating apparatus (such as a coater) for coating a photoresist.

In the air conditioner 1, the air that flows as described above is cooled by the cooling unit 31 and is heated by the heating unit 41, such that a temperature of the use area U is controlled toward a preset target use temperature. In addition, in this embodiment, a humidifier 70 is disposed on the downstream side of the heating unit 41 in the downstream flow path unit 10D. Thus, a humidity of the temperature control target air is also controlled toward a preset target use humidity. The control unit 60 is configured to control a cooling capacity of the cooling unit 31, a heating capacity of the heating unit 41 and a humidification of the humidifier 70, in order that the use area U can have a desired temperature and a desired humidity.

The cooling unit 31, in cooperation with a compressor 32, a condenser 33 and an expansion valve 34, constitutes a cooling circuit 30. The cooling circuit 30 is formed by connecting the cooling unit 31, the compressor 32, the condenser 33 and the expansion valve 34 in this order by pipes 35, such that a heating medium is circulated therethrough. The cooling unit 31 is a cooling coil through which a heating medium of a low temperature from the expansion valve 34 flows, and the cooling unit 31 is configured to enter heating medium into the compressor 32.

The compressor 32 compresses the gaseous heating medium flowing out from the cooling unit 31, which has a low temperature and a low pressure, into a gaseous heating medium having a high temperature (e.g., 80° C.) and a high pressure, and supplies the gaseous heating medium to the condenser 33. The compressor 32 is an inverter compressor that is operated at a variable operation frequency, and is capable of adjusting a rotation speed depending on an operation frequency. As an operation frequency of the compressor 32 increases, a larger amount of the heating medium is supplied to the condenser 33. A scroll type compressor is preferably employed as the compressor 32. However, as long as a supply quantity (flowrate) of the heating medium can be adjusted by adjusting a rotation speed based on an operation frequency adjustment by an inverter, the type of the compressor 32 is not particularly limited.

The condenser 33 cools and condenses, by means of cooling water, the heating medium compressed by the compressor 32 into a liquid heating medium having a predetermined cooled temperature (e.g., 40° C.) and a high pressure, and supplies the liquid heating medium to the expansion valve 34. Water may be used as the cooling water of the condenser 33, or another refrigerant may be used. The expansion valve 34 expands the heating medium supplied from the condenser 33 to decompress it into a gas-liquid mixed heating medium having a low temperature (e.g., 2° C.) and a low pressure, and supplies the gas-liquid mixed heating medium to the cooling unit 31. The cooling unit 31 heat-exchanges the heating medium supplied thereto with the temperature control target air, so as to cool the air. The heating medium having been heat-exchanged with the air becomes a gaseous heating medium having a lower temperature and a low pressure, and flows out from the cooing unit 31 so as to be again compressed by the compressor 32.

In the cooling circuit 30, a supply quantity of the heating medium to be supplied to the condenser 33 can be adjusted by varying an operation frequency of the compressor 32 to adjust its rotation speed, as well as an opening degree of the expansion valve 34 can be adjusted, whereby a supply quantity of the heating medium to be supplied to the cooing unit 31 can be adjusted. Due to such an adjustment, a cooling capacity is variable.

On the other hand, the heating unit 41 is an electric heater, for example. More specifically, an electric heater formed of a sheathed heater or a fin heater or a combination thereof can be employed as the heating unit 41.

In the duct 10 in this embodiment, the upstream flow path unit 10U and the downstream flow path unit 10D are joined to define an L shape. In this example, the upstream flow path unit 10U is located to extend along an up and down direction, while the downstream flow path unit 10D is located to extend along a horizontal direction. The shape of the duct 10 is not limited to the L shape, and may be linear, for example.

Figure 2:
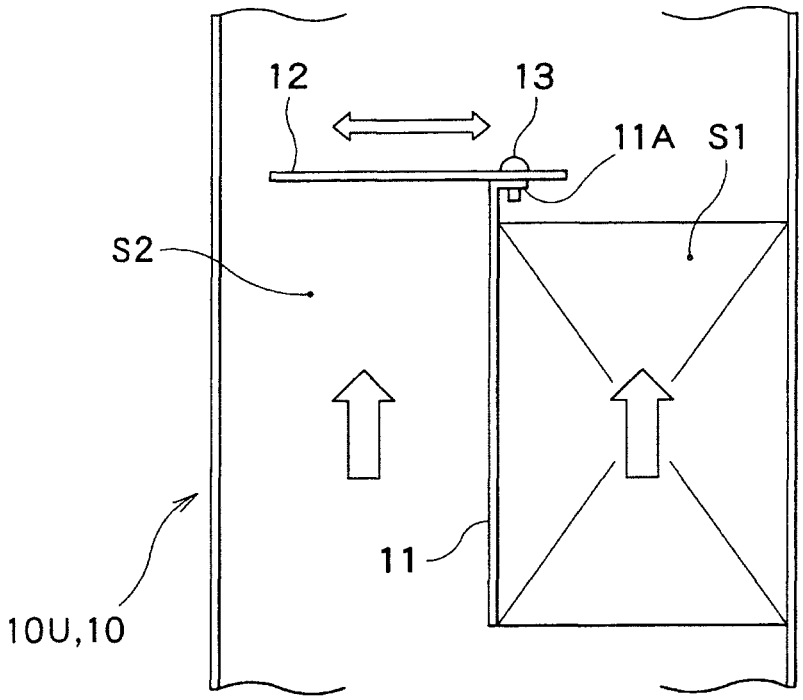
FIG. 2 is a view showing an upstream flow path unit of a duct provided in the air conditioner shown in FIG. 1.

FIG. 2 is a view showing the upstream flow path unit 10U of the duct 10. The upstream flow path unit 10U of the duct 10 in this embodiment has a partition plate 11 that partitions its inside space into a main-flow flow path S1 and a sub-flow flow path S2. The cooling unit 31 is positioned in the main-flow flow path S1. The upstream flow path unit 10U is provided with a flowrate adjusting member 12 which covers at least a part of the sub-flow flow path S2 so as to adjust an opening area (flow path area) of the sub-flow flow path S2. The flowrate adjusting member 12 in this embodiment is disposed on the partition plate 11, and is formed to have a plate-like shape.

The flowrate adjusting member 12 in this embodiment is disposed on the partition plate 11 so as to extend along a direction crossing a direction in which the temperature control target air flows in the upstream flow path unit 10U. In the illustrated example, the upstream flow path unit 10U linearly extends and the partition plate 11 also extends linearly along the upstream flow path unit 10U, so that the temperature control target air linearly flows both in the main-flow flow path S1 and the sub-flow flow path S2 in the upstream flow path unit 10U. As described above, the flowrate adjusting member 12 is disposed on the partition plate 11 so as to extend along the direction perpendicular to the direction in which the air linearly flows in the upstream flow path unit 10U (i.e., the extension direction of the upstream flow path unit 10U).

In this embodiment, the flowrate adjusting member 12 is removably fixed by a bolt 13 on a fixation plate part 11A which is located on a downstream end of the partition plate 11 such that the fixation plate part 11A is bent from the downstream end. After the bolt 13 has been removed and the position of the flowrate adjusting member 12 has been changed, or after another flowrate adjusting member 12, in which a bolt hole through which the bolt 13 passes is located on a different position, has been prepared, by again fixing the same flowrate adjusting member 12 or the other flowrate adjusting member 12 onto the partition plate 11 by the bolt 13, the opening area of the sub-flow flow path S2 can be adjusted. In the case that the same flowrate adjusting member 12 is disposed on the partition plate 11 such that a position thereof can be changed, a plurality of bolt holes are formed in the flowrate adjusting member 12. In this case, a bolt hole(s) through which the bolt 13 does not pass is(are) preferably closed.

Figure 3A:
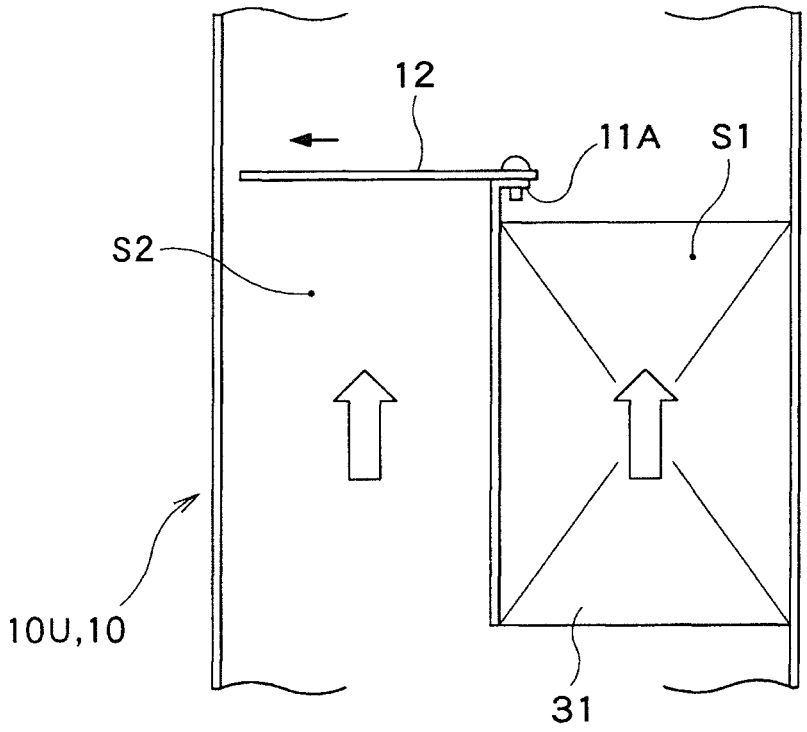
FIGS. 3(A) and (B) are views for explaining a condition in which a position of a flowrate adjusting member provided in the upstream flow path unit of the duct shown in FIG. 2 is changed.
Figure 3B:
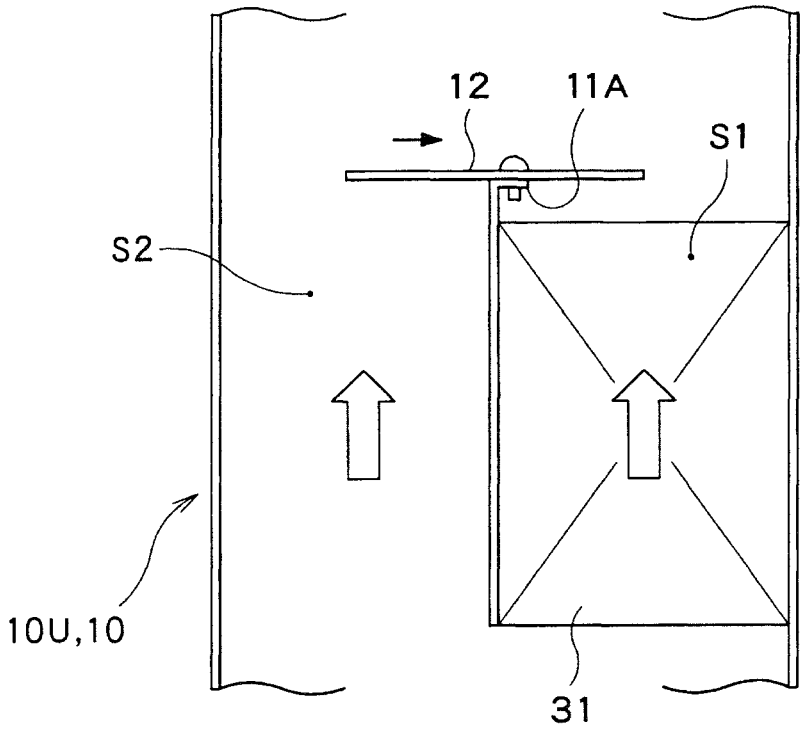

FIG. 3(A) shows a condition in which the position of the flowrate adjusting member 12 is changed such that the opening area of the sub-flow flow path S2 becomes smaller than the condition shown in FIG. 2. FIG. 3(B) shows a condition in which the position of the flowrate adjusting member 12 is changed such that the opening area of the sub-flow flow path S2 becomes larger than the condition shown in FIG. 2. In this example, the same flowrate adjusting member 12 is used in the conditions shown in FIG. 2 and FIGS. 3(A) and (B). In this case, when the position of the flowrate adjusting member 12 is changed in a direction where the opening area of the sub-flow flow path S2 decreases, the opening area of the main-flow flow path S1 increases. Conversely, when the position of the flowrate adjusting member 12 is changed in a direction where the opening area of the sub-flow flow path S2 increases, the opening area of the main-flow flow path S1 decreases.

In such a duct 10, the upstream flow path unit 10U of the duct 10, in which the cooling unit 31 is installed, is partitioned by the partition plate 11 into the main-flow flow path S1 and the sub-flow flow path S2, and the opening area of the sub-flow flow path S2, in which the cooling unit 31 is not installed, is adjusted by the flowrate adjusting member 12, whereby flowrates of air to be cooled and air not to be cooled can be adjusted. By adjusting the cooling capacity of the cooling unit 31 depending on a flowrate of the air to be cooled, energy can be saved. Although the flowrate adjusting member 12 in this embodiment has a plate-like shape, its shape and structure is not particularly limited, as long as it can adjust the opening area of the sub-flow flow path S2. For example, the flowrate adjusting member 12 may be a butterfly valve or the like. However, as in this embodiment, when the flowrate adjusting member 12 has a plate-like shape and is disposed on the partition plate 11, the productivity can be improved because of its simple structure.

Figure 4:
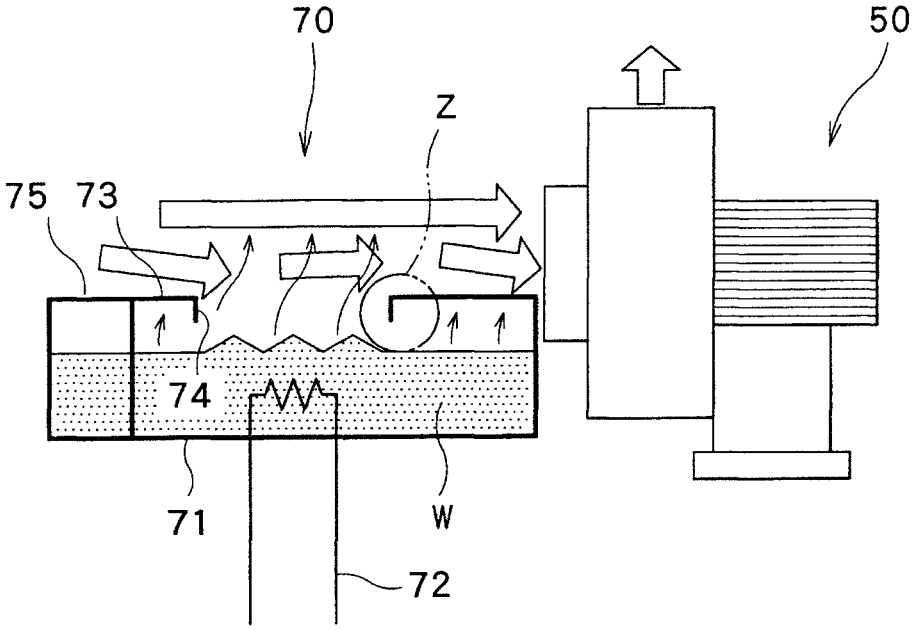
FIG. 4 is a side sectional view of a humidifier and a view of a blower provided in the air conditioner shown in FIG. 1.

Next, the humidifier 70 is described. FIG. 4 shows the humidifier 70 in this embodiment. The humidifier 70 includes a storage tank 71 that is open upward and stores water W, a heater 72 that heats the water W in the storage tank 71, and a cover 73 that covers the storage tank 71 from above. The cover 73 is partly provided with an opening 74 passing therethrough in the up and down direction. In FIG. 4, the reference number 75 depicts a supply tank joined to a side surface of the storage tank 71. The storage tank 71 and the supply tank 75 communicate with each other through a communication channel, not shown. In the humidifier 70, water supplied to the supply tank 75 is configured to be supplied to the storage tank 71 through the aforementioned communication channel.

Figure 5:
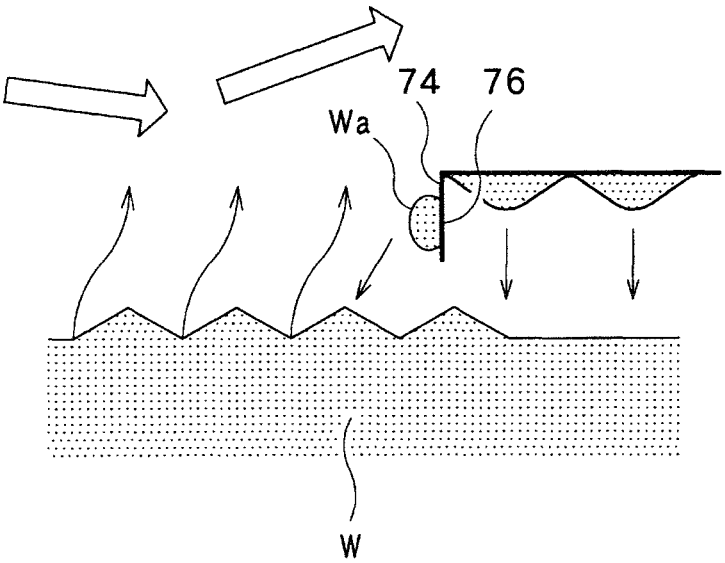
FIG. 5 is an enlarged view of a main part of the humidifier shown in FIG. 4.

The cover 73 is formed to have plate-like shape, and covers the storage tank 71 from above. FIG. 5 is an enlarged view of a main part of the cover 73, which is shown by the sign Z in FIG. 4. As shown in FIG. 5, in this embodiment, a periphery of the opening 74 is provided with a surrounding part 76 that projects toward a bottom side of the storage tank 71 and extends entirely over the periphery. In this example, although the surrounding part 76 entirely extends over the periphery of the opening 74, the surrounding part 76 may extend partly over the periphery of the opening 74.

In addition, as shown in FIGS. 1 and 4, in this embodiment, the heating unit 41, the humidifier 70 and the blower 50 are arranged side by side in the horizontal direction. The opening 74 is located at a position in the cover 73, which position is closer to the heating unit 41 than an end of the cover 73 on the side of the blower 50. In addition, the illustrated opening 74 is a single opening having an area that is 20% to 60% relative to a whole area of the cover 73 in a plan view. The "whole area in a plan view" means an area of a zone surrounded by an outer periphery of the cover 73 in a plan view. The present inventor has found that precision in humidity control can be improved when the opening 74 is a single opening having an area a ratio of which is included within the aforementioned range relative to the whole area of the cover 73 in a plan view, and thus has set the area of the opening 74 within this range. The area of the opening 74 is more preferably 35% to 45% relative to the whole area of the cover 73 in a plan view. In addition, a plurality of the openings 74 may be provided.

Figure 6:
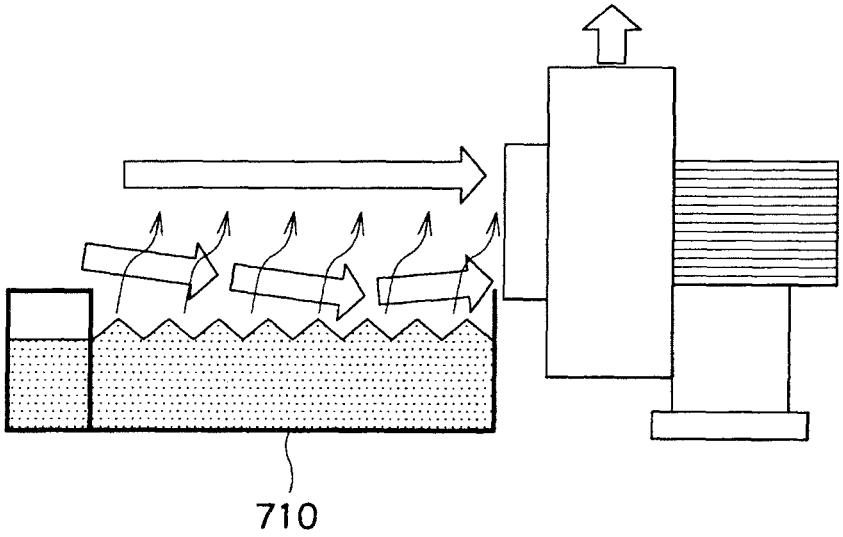
FIG. 6 is a view showing a general humidifier.

In such a humidifier 70, the storage tank 71 is covered with the cover 73 in which the opening 74 is partly formed, so as to reduce a portion a water surface of the water W in the storage tank 71, which is exposed to an air flow. Thus, as shown in FIG. 4, a turbulence in the water surface can be restrained. On the other hand, FIG. 6 shows a general humidifier. When a storage tank 710 is entirely open upward as in this humidifier, a water surface of water in the storage tank 71 is widely exposed to an air flow, whereby a turbulence in the water surface increases. When the turbulence of the water surface is large, steam to be supplied to air increases unexpectedly because a surface area of the water surface increases. In this case, there is a possibility that stability in humidity control is impaired. To the contrary, due to the structure according to this embodiment, since the turbulence of the water surface of the water in the storage tank 71 is restrained, precision in humidity control can be improved.

Next, the control unit 60 is described. The control unit 60 in this embodiment controls a cooling capacity of the cooling unit 31, a heating capacity of the heating unit 41, a humidification of the humidifier 70 and so on, depending on values detected by various sensors. In this embodiment, an ambient temperature sensor 81, an ambient humidity sensor 82, a cooled temperature sensor 83, a source temperature sensor 84, a source humidity sensor 85, a use temperature sensor 86 and a use humidity sensor 87 are connected to the control unit 60.

The ambient temperature sensor 81 is positioned in the sub-flow flow path S2 of the upstream flow path unit 10U, and detects a temperature of air taken in from the inlet 21 and is not cooled by the cooling unit 31. The ambient humidity sensor 82 is positioned in the sub-flow flow path S2 of the upstream flow path unit 10U, and detects a humidity of air taken in from the inlet and is not cooled by the cooling unit. The cooled temperature sensor 83 detects a temperature of air that is cooled by the cooing unit 31 and is not yet heated by the heating unit 41. The source temperature sensor 84 is positioned in the connection flow path 51 through which air discharged by the blower 50 passes, and detects a temperature of air passing through the connection flow path 51. The source humidity sensor 85 is positioned in the connection flow path 51, and detects a humidity of air passing through the connection flow path 51. The use temperature sensor 86 is positioned in the use area U, and detects a temperature of air in the use area U. The use humidity sensor 87 is positioned in the use area U, and detects a humidity of air in the use area U.

A specific process of the control unit 60 is described. The control unit 60 in this embodiment computes a cooling capacity of the cooling unit 31 by which a temperature detected by the cooled temperature sensor 83 conforms to a target temperature, based on an ambient temperature detected by the ambient temperature sensor 81, an ambient humidity detected by the ambient humidity sensor 82, an air quantity (in this example, computed based on a driving condition of the blower 50), a ratio between a flowrate of the main-flow flow path S1 and a flowrate of the sub-flow flow path S2 determined by an installation condition of the flowrate adjusting member 12, a temperature detected by the cooled temperature sensor 83, etc., and controls an operation frequency of the compressor 32 such that the cooling unit 31 has the computed cooling capacity. The control unit 60 in this embodiment also controls an opening degree of the expansion valve 34 through a pulse converter 52, such that a heating medium in the cooling circuit 30 is held at a constant pressure. Thus, since the pressure of the heating medium is maintained constant, the cooling capacity of the cooling unit 31 can be stabilized.

In addition, the control unit 60 sets a target source temperature and a target source humidity of the temperature control target air passing through the connection flow path 51, based on a difference between a temperature detected by the use temperature sensor 86 and a target use temperature preset for the use area U and a difference between a humidity detected by the use humidity sensor 87 and a target use humidity preset for the use area U. Then, the control unit 60 computes a heating capacity of the heating unit 41 by which a temperature detected by the source temperature sensor 84 conforms to the target source temperature, based on a difference between a temperature detected by the source temperature sensor 84 and the target source temperature and a difference between a humidity detected by the source humidity sensor 85 and the target source humidity, and controls the heating unit 41 such that the heating unit 41 can have the computed heating capacity. In addition, the control unit 60 computes a humidification of the humidifier 70 by which a humidity detected by the source humidity sensor 85 conforms to the target source humidity, and controls the humidifier 70 such that the humidifier 70 can have the computed humidification.

Next, an operation of the air conditioner 1 according to this embodiment is described.

In the air conditioner 1, a target use temperature which is a target temperature of the use area U, and a target use humidity which is a target humidity of the use area U are firstly inputted to the control unit 60. In addition, by driving the blower 50, air in the duct 10 is made to flow toward the outlet 22, so that air whose temperature is to be controlled (temperature control target air) is taken in from the inlet 21 of the duct 10. Further, the compressor 32 of the cooling circuit 30 is driven.

The air taken in from the inlet 21 of the duct 10 flows through the main-flow flow path S1 and the sub-flow flow path S2 depending on a ratio between a flowrate of the main-flow flow path S1 and a flowrate of the sub-flow flow path S2 determined by an installation condition of the flowrate adjusting member 12. The ratio between the flowrates of the main-flow flow path S1 and the sub-flow flow path S2 is selected and set depending on an environment where the air conditioner 1 is used. To be specific, the ratio is set such that it can restrain the cooling capacity by the cooling unit 31 as much as possible in accordance with an environment where the air conditioner 1 is used, as well as it allows energy saving.

For example, when a temperature of an environment where the air conditioner 1 is used is relatively low, the opening area of the sub-flow flow path S2 is preferably set relatively large in order that an amount of air flowing through the sub-flow flow path S2 is larger than an amount of air flowing through the main-flow flow path S1. Thus, an amount of air to be cooled by the cooling unit 31 can be decreased, whereby energy can be saved. On the other hand, when a temperature of an environment where the air conditioner 1 is used is relatively high, the opening area of the sub-flow flow path S2 is preferably set relatively small or the sub-flow flow path S2 is preferably closed in order that an amount of air flowing through the sub-flow flow path S2 is smaller than air flowing through the main-flow flow path S1. Thus, in a case where a temperature of taken-in air has to be considerably lowered, the air can be efficiently cooled.

The air flowing through the main-flow flow path S1 is cooled by the cooling unit 31. Immediately after the cooling, a temperature of the air is detected by the cooled temperature sensor 83. On the other hand, a temperature of the air flowing through the sub-flow flow path S2 is not controlled. After the air has flown through the sub-flow flow path S2, the air merges with the cooled air having passed through the main-flow flow path S1. After that, the merged air is heated by the heating unit 41, and is then humidified by the humidifier 70. Finally, the air reaches the use area U. At this time, a temperature of the air having been humidified by the humidifier 70 is detected by the source temperature sensor 84, and a humidity thereof is detected by the source humidity sensor 85. In addition, a temperature of the air having reached the use area U is detected by the use temperature sensor 86, and a humidity thereof is detected by the use humidity sensor 87. Then, the control unit 60 carries out a control based on the various sensors, whereby the temperature and the humidity of the use area U are controlled toward the set target use temperature and the target use humidity.

According to the air conditioner 1 in this embodiment described above, the upstream flow path unit 10U of the duct 10, in which the cooling unit 31 is installed, is partitioned by the partition wall 11 into the main-flow flow path S1 and the sub-flow flow path S2, and the opening area of the sub-flow flow path S2, in which the cooling unit 31 is not installed, is adjusted by the flowrate adjusting member 12, whereby a flowrates of air to be cooled and air not to be cooled can be adjusted without enlarging the duct 10. In addition, by adjusting the cooling capacity of the cooling unit 31 depending on a flowrate of air to be cooled, energy can be saved. As a result, by means of a member such as the duct 10 that can adjust flowrates of air to be cooled and air not to be cooled, energy saving can be achieved without enlarging the air conditioner as a whole.

In addition, since the flowrate adjusting member 12 is removably disposed, flowrates of air to be cooled and air not to be cooled can be flexibly adjusted. In addition, since the flowrate adjusting member 12 is disposed on the partition plate 11, an installation structure of the flowrate adjusting member 12 can be simplified as compared with a case in which the flowrate adjusting member 12 is directly disposed on the duct 10, which invites improvement in productivity. In particular, since the flowrate adjusting member 12 is formed to have a plate-like shape, and the flowrate adjusting member 12 is disposed on the partition plate 11 so as to extend along a direction crossing a direction in which a temperature control target air flows in the upstream flow path unit 10U, the installation structure of the flowrate adjusting member 12 can be significantly simplified so that the productivity can be effectively improved.

In addition, since the upstream flow path unit 10U and the downstream flow path unit 10D are joined to define an L shape, the air conditioner can be easily made smaller as a whole, as compared with a case in which the upstream flow path unit and the downstream flow path unit are linearly joined.

In addition, the air conditioner 1 further includes the blower 50, which is disposed on the downstream side of the outlet 22 and causes a temperature control target air to flow from the inlet 21 to the outlet 22, and the humidifier positioned in the downstream flow path unit 10D. The humidifier 70 includes the storage tank 71 that is open upward and stores water, the heater 72 that heats the water W in the storage tank 71, and the cover 73 that covers the storage tank 71 from above. The cover 73 is partly provided with the opening 74 passing therethrough in the up and down direction. Thus, since a turbulence of water surface of the water in the storage tank 71, which is affected by air passing through the humidifier 70, can be restrained, precision in humidity control can be improved.

Further, the periphery of the opening 74 is provided with a surrounding part 76 that projects toward the bottom side of the storage tank 71 and at least partly extends over the periphery. Thus, as shown in FIG. 5, even when a water droplet Wa adheres to the periphery of the opening 74, the water droplet Wa is guided to the surrounding part 76 because of its increasing own weight by growth so as to be easily returned to the storage tank 71. Thus, since water droplets adhering to the periphery of the opening 74 are prevented from being affected by air to scatter toward the duct, precision in humidity control can be improved.

In addition, the humidifier 70 is positioned on the downstream side of the heating unit 41, the heating unit 41, the humidifier 70 and the blower 50 are arranged side by side in the horizontal direction, and the opening 74 is located at a position in the cover 73, which position is closer to the heating unit 41 than the end of the cover 73 on the side of the blower 50. Eddies tend to be generated in the vicinity of the blower 50. However, due to this structure, an area in which eddies tend to be generated is distant from the opening 74, the humidity control can be prevented from being affected and disturbed by eddies. Thus, precision in humidity control can be improved.

Although the one embodiment of the present invention has been described above, the present invention is not limited to the aforementioned embodiment.

1 Air conditioner
10 Duct
10U Upstream flow path unit
10D Downstream flow path unit
11 Partition plate
12 Flowrate adjusting member
21 Inlet
22 Outlet
30 Cooling circuit
31 Cooling unit
32 Compressor

33 Condenser
34 Expansion valve
41 Heating unit
50 Blower
51 Connection flow path
60 Control unit
70 Humidifier
71 Storage tank
72 Heater
73 Cover
74 Opening
75 Supply tank
76 Surrounding part
81 Ambient temperature sensor
82 Ambient humidity sensor
83 Cooled temperature sensor
84 Source temperature sensor
85 Source humidity sensor
86 Use temperature sensor
87 Use humidity sensor
S1 Main-flow flow path
S2 Sub-flow flow path

What is claimed is:

1. An air conditioner comprising:

a duct including an upstream flow path conduit part provided with an inlet through which an air whose temperature is to be controlled is taken in, and a downstream flow path conduit part provided with an outlet through which the air whose temperature is to be controlled is discharged;

a cooling unit that is positioned in the upstream flow path conduit part of the duct and cools the air whose temperature is to be controlled;

a heating unit that is positioned in the downstream flow path conduit part of the duct and heats the air whose temperature is to be controlled;

a blower that is positioned on a downstream side of the outlet, and causes the air whose temperature is to be controlled to flow from the inlet to the outlet; and a humidifier positioned in the downstream side flow path conduit part;

wherein the upstream flow path conduit part has a partition plate that partitions an inside space thereof into a main-flow flow path and a sub-flow flow path;

wherein the cooling unit is positioned in the main-flow flow path;

wherein the upstream flow path conduit part is provided with a flowrate adjusting means for adjusting an opening area of the sub-flow flow path that covers at least a part of the sub-flow flow path;

wherein the upstream flow path conduit part and the downstream flow path conduit part are joined to define an L shape;

wherein the heating unit, the humidifier and the blower are arranged side by side in a horizontal direction in a downstream side flow path;

wherein the humidifier includes a storage tank that is open upward and stores water, a heater that heats the water in the storage tank, and a cover that covers the storage tank from above, wherein the cover is partly provided with an opening passing therethrough in an up and down direction;

wherein a periphery of the opening is provided with a surrounding part that projects toward a bottom side of the storage tank and extends at least partly over the periphery; and wherein the humidifier is positioned on the downstream side of the heating unit and the opening is located at a position in the cover that is closer to the heating unit than an end of the cover on the side of the blower.

2. The air conditioner according to claim 1, wherein the opening is a single opening having an area that is 20% to 60% relative to a whole area of the cover in a plan view.

* * * * *